US009409274B2

(12) United States Patent
Nowak et al.

(10) Patent No.: US 9,409,274 B2
(45) Date of Patent: Aug. 9, 2016

(54) TOOL FOR THE POLISHING OF OPTICAL SURFACES

(71) Applicant: Carl Zeiss Vision International GmbH, Aalen (DE)

(72) Inventors: Gerd Nowak, Neresheim (DE); Georg Michels, Aalen (DE)

(73) Assignee: Carl Zeiss Vision International GmbH, Aalen (DE)

( * ) Notice: Subject to any disclaimer, the term of this patent is extended or adjusted under 35 U.S.C. 154(b) by 0 days.

(21) Appl. No.: 14/516,428

(22) Filed: Oct. 16, 2014

(65) Prior Publication Data

US 2015/0105002 A1 Apr. 16, 2015

(30) Foreign Application Priority Data

Oct. 16, 2013 (DE) ..... 10 2013 220 973

(51) Int. Cl.
*B24B 13/00* (2006.01)
*B24B 13/01* (2006.01)

(52) U.S. Cl.
CPC ..... *B24B 13/01* (2013.01)

(58) Field of Classification Search
CPC ..... B24B 13/01; B24B 13/005; B24B 13/02; B24B 13/002
USPC ..... 451/42
See application file for complete search history.

(56) References Cited

U.S. PATENT DOCUMENTS 1,651,181 A * 11/1927 Bugbee ..... B24B 13/01 264/261
RE25,620 E * 7/1964 Sarofeen ..... C09K 3/1463 451/42
3,144,737 A * 8/1964 Faas ..... B24B 13/01 451/42
3,262,233 A * 7/1966 Schrier ..... B24B 13/00 351/159.74
4,530,139 A * 7/1985 Miller ..... H03H 3/04 29/25.35
4,733,502 A * 3/1988 Braun ..... B24B 13/00 451/42
5,000,761 A * 3/1991 Mayton ..... B24B 13/01 106/3
5,095,660 A * 3/1992 Dillon ..... B24B 13/01 451/163
5,384,988 A * 1/1995 Hernandez ..... B24D 9/085 451/42
5,527,368 A * 6/1996 Supkis ..... B24B 13/02 51/295
6,089,963 A * 7/2000 Wiand ..... B24B 13/02 451/390
6,926,597 B2 * 8/2005 Sangster ..... B24D 11/00 451/42
7,033,261 B2 4/2006 Huguet
7,278,908 B2 10/2007 Urban et al.
8,246,424 B2 8/2012 Philipps et al.
2004/0043710 A1 * 3/2004 Miyazawa ..... B24B 13/01 451/42
2004/0224619 A1 * 11/2004 Granziera ..... B24B 13/02 451/277
2008/0305723 A1 * 12/2008 Philipps ..... B24B 13/02 451/158
2010/0151772 A1 * 6/2010 Schneider ..... B24B 13/01 451/42
2010/0159808 A1 * 6/2010 Shimodaira ..... B24B 1/00 451/36
2010/0190415 A1 * 7/2010 Schneider ..... B24B 13/06 451/42
2011/0104998 A1 * 5/2011 Valencia Merizalde ..... B24B 13/02 451/526
2011/0124272 A1 * 5/2011 Felten ..... B24B 13/0057 451/42
2011/0275295 A1 * 11/2011 Nowak ..... B24B 13/00 451/540
2013/0130599 A1 * 5/2013 Miyazaki ..... B24D 3/28 451/59

* cited by examiner

*Primary Examiner* — George Nguyen
(74) *Attorney, Agent, or Firm* — Walter Ottesen, P.A.

(57) ABSTRACT

A tool for the polishing of an optical surface has a base which has an active surface facing the optical surface. An intermediate layer is arranged on the active surface of the base. A polishing agent carrier is arranged on the elastic intermediate layer. The elastic intermediate layer projects radially beyond the active surface of the base and the polishing agent carrier projects radially beyond the elastic intermediate layer.

27 Claims, 2 Drawing Sheets

TOOL FOR THE POLISHING OF OPTICAL SURFACES

CROSS REFERENCE TO RELATED APPLICATION

This application claims priority of German patent application no. 10 2013 220 973.8, filed Oct. 16, 2013, the entire content of which is incorporated herein by reference.

FIELD OF THE INVENTION

The invention relates to a tool for the polishing of an optical surface, having a base which has an active surface facing the optical surface, an elastic intermediate layer arranged on the active surface of the base, and a polishing agent carrier arranged on the elastic intermediate layer. The subject of the invention is also the use of such a tool for machining the optical surfaces of spectacle lenses made of plastic and a method for machining such plastic lenses.

BACKGROUND OF THE INVENTION

Spectacle lenses are generally produced from blanks via material-removing machining of the prescription surfaces within the context of prescription fabrication. After this machining step, the optical properties of the lens are defined by the surface form produced in this way. The machined surface is then polished further, by which means a microscopically smooth surface and the desired optical properties of the lens are intended to be achieved.

For the purpose of polishing, use is generally made of a polishing tool, of which the polishing surface formed by a polishing agent carrier is matched approximately to the form of the surface of the lens that is to be polished. This at least approximate matching to the form of the lens surface to be polished can be handled with tolerable outlay for the polishing of spherical or toroidal prescription surfaces. However, in the case of spectacle lenses the proportion of highly accurate free-form surfaces increases sharply, normally being generated with the aid of diamond tools on CNC-controlled machines in the rotary process.

Aspherical or point-symmetrical surfaces and free-form surfaces have curvatures which change over the surface. The polishing tool is moved at least over a part of this irregularly curved surface during the polishing of such free-form surfaces. The polishing tool must therefore be able to match the respective local curvature with its flexural rigidity and elasticity, specifically in such a way that the polishing pressure is as constant as possible over the contact area. Only then is the result a determinable constant removal and the polished surface is polished uniformly. If this is not ensured, the surface and the topography of the free-form surface will be deformed and its optical quality impaired. On the other hand, local irregularities which have arisen on account of the material-removing machining process, for example grooves, waves or central defects, should be eliminated without a trace.

SUMMARY OF THE INVENTION

It is an object of the invention to provide a tool and a method with the properties mentioned above which permit smooth, economical and particularly high-quality polishing of the optical surfaces, in particular of plastic lenses.

In the case of the tool according to the invention, this object is achieved in that the elastic intermediate layer projects radially beyond the active surface of the base and in that the polishing agent or medium carrier projects radially beyond the elastic intermediate layer.

Firstly, some terms used within the context of the invention should be explained. The tool according to the invention is used for the precise machining of an optical surface, in particular for polishing such an optical surface. This concerns machining in which no change or no substantial change in the form of this surface is made.

The base is used to connect the tool to a machine tool, in particular a CNC-controlled system. For this purpose, it generally has an appropriate receptacle.

The base has an active surface which, in use, faces the optical surface of the lens to be machined. The active surface is thus that surface of the base via which the force required for polishing or machining is transferred to the optical surface of the lens.

On the active surface of the base there is arranged an elastic intermediate layer. In this case, this is preferably a resilient or elastic foam. On account of the elastic deformability of this layer, the polishing surface of the tool according to the invention, formed by the polishing agent carrier that is still to be explained, is able to adapt to a certain extent to the geometry of the lens to be machined.

A polishing agent carrier is arranged on the elastic intermediate layer. Here, this is a part of the tool according to the invention that comes directly into contact with the optical surface of the lens to be machined.

According to the invention, provision is made for the areas of polishing agent carrier, elastic intermediate layer and active surface of the base, facing the optical surface to be machined, to decrease gradually, therefore for the polishing agent carrier with respect to the elastic intermediate layer and this elastic intermediate layer with respect to the base each to have an overhang in the radial direction. The radial direction is that direction which lies in the plane or tangential plane of the optical surface to be machined, that is, approximately perpendicular to the axis of rotation of the tool. In this connection, an overhang means that a force from the base acting in the axial direction no longer acts directly on the overhanging region of the elastic intermediate layer and, accordingly, an axial force from the elastic intermediate layer no longer acts directly on the overhanging region of the polishing agent carrier.

The technological objective existing during the polishing of plastic lenses is the production of a microscopically sufficiently smooth surface structure that is free of any waviness. This is a matter of eliminating both the grooves arising as a result of the turning process during the material-removing machining and also optically disruptive waviness on the surface. Such waviness arises during the turning process using diamond tools, to a certain extent necessarily, for example as a result of inaccuracies in the diamond cutting contour, as a result of influences from the machine control and/or as a result of small inaccuracies of mechanical components of the turning machine, for example that of the bearings of the machine axes. In addition, in the region of the center of the optical surface produced via the turning process, a surface defect that is typical of this process is produced, being primarily brought about by the cutting speed, which approaches zero at this point. Such a surface defect in the center of the lens is frequently intensified by a position of the turning diamond which is not always adjusted perfectly in practice. Typical characteristic data of such optically relevant waviness in the case of diamond-turned lenses are amplitudes in the range between 0.5 and 3 μm and wavelengths from about 1 to several millimeters. A central defect as explained above typically has an extent of about 0.5 to 3 μm in height and a diameter of about 1 to 3 mm.

The configuration according to the invention of the tool with the "double overhang" described permits the provision of a tool which, firstly, has a large active surface (a large area of the polishing agent carrier which, in use, comes into engagement with the optical surface of the lens) and, secondly, has a good ability to match this active surface to the optical surface of the lens, even if this involves an irregularly formed optical surface, for example a free-form surface.

By contrast, in the prior art, such free-form surfaces are machined with polishing tools that are smaller as compared with the optical surface (diameter less than 50 mm, for example), since these are more easily matched to the optical surface to be machined than larger tools.

The use of tools with a relatively large active surface, possible by using the tool according to the invention, permits substantially faster machining of an optical surface and therefore a shortening of the polishing operation.

For a polishing result that is of high quality from optical points of view, it is advantageous if the polishing force exerted on the lens by the tool decreases outwards in the edge region of the tool surface, ideally approaches zero continuously. Otherwise, spiral structures that are visible on the polished lens and impair the quality of the surface can arise.

The overhang, present in the tool according to the invention, of the elastic intermediate layer over the active surface of the base, on the one hand, and of the polishing agent carrier over the elastic intermediate layer, on the other hand, permits a good approximation to the ideal of the continuous decrease in the polishing force towards the edge. The polishing force acting in the center of the tool (in the extension of the drive axis of the machine tool) approaches zero at the edge of the tool, since only the polishing agent carrier is present there, which is no longer supported, is generally flexible and on which the axially acting polishing force virtually no longer acts in this edge region. During the rotation of the tool, this edge region receives only a low force component in the direction of the optical surface to be machined as a result of components of the centrifugal forces, in particular when a concave optical surface is involved, and in addition a small force component which depends on the flexural rigidity and elasticity of the polishing agent carrier used.

In the transition region, in which the polishing agent carrier is supported only by the elastic intermediate layer, this elastic intermediate layer applies a lower force in the axial direction (polishing force), which depends substantially on the material properties of this elastic intermediate layer.

The forces acting in the axial direction in this transition region can be increased by an additional layer, for example a tear-resistant polyurethane film, being arranged between base and elastic intermediate layer (foam), for example by adhesive bonding.

As a result, the flexural rigidity of the elastic intermediate layer is increased on this side but, at the same time, the elastic material properties that are relevant to the polishing process are not fundamentally changed.

More intense loading with an axially acting polishing force is carried out only in the central region of the tool, which is supported over the entire area or substantially over the entire area by the active surface of the base.

According to the invention, the active surface of the base preferably has a surface curvature which is at least approximately matched to an optical surface of the lens that is to be machined (that is, is formed approximately as a mating surface). This permits a relatively uniform transmission of force to the optical surface to be machined. The active surface can in particular be formed spherically or toroidally. For different surfaces to be machined (for example, convexly or concavely curved surfaces), a multiplicity of tools accordingly have to be provided.

Exact shaping of the active surface as a mating surface, for example to free-form surfaces of spectacle lenses, is not necessary; the shaping according to the invention here permits an adequately uniform transmission of force with a continuous decrease in the polishing force towards the edge of the tool, so that a good surface quality can be achieved with little removal of material, and the polishing defects described above do not occur or at most occur to an unimportant extent.

Preferably, the overhang of the elastic intermediate layer over the active surface of the base in the radial direction is 2-10 mm, further preferably 3-8 mm. Likewise, the overhang of the polishing agent carrier over the elastic intermediate layer in the radial direction is preferably 2-10 mm, further preferably 3-8 mm. Via this overhang in the edge region of the tool, an improvement in the ability to match the geometry of the optical surface to be machined is achieved; in addition a reduction in the polishing force towards the edge of the tool, which is important for the optical quality of the polished surface, is achieved.

The effective diameter of the polishing agent carrier (measured diametrically from edge to edge of the polishing agent carrier in the maximum radial extent of the latter, including the overhanging edge regions) is preferably 40-80 mm, further preferably 50-70 mm. This preferred embodiment concerns a tool with a diameter that is relatively large, in particular for the machining of plastic lenses, and therefore a relatively large active polishing area, which makes faster machining of the optical surface possible. The configuration according to the invention with the radially projecting or overhanging regions of elastic intermediate layer and polishing agent carrier permits the machining of plastic lenses with a tool that is very large in relation to the optical surface to be machined, without any impairment to the quality of the optical surface occurring. The invention thus combines the advantage of large tools with regard to efficiency and short machining times with the advantage of smaller tools with regard to the ability to match different forms of the optical surfaces to be machined and with regard to a largely homogeneous pressure distribution over the surface to be machined during the machining operation.

The diameter of the active surface of the base is preferably 50-85% of the effective diameter of the polishing agent carrier. Further preferred ranges are 60-70%. As a result of the resulting overhang of the polishing agent carrier over the edge of the base, the result is the above-described advantages with regard to the ability to match the geometry of the optical surface to be polished and the reduction in the polishing force towards the edge of the tool. Both the active surface of the base and the polishing agent carrier are preferably of substantially circular design, in order to facilitate uniform polishing in the course of the usual rotational movement of the tool. The polishing agent carrier can have discontinuities, openings or cut-outs on the circumferential edge, as will be described in more detail below.

The elastic intermediate layer preferably has a foam, further preferably a foam having a static modulus of elasticity of 0.1-0.5 $N/mm^2$, further preferably 0.2-0.4 $N/mm^2$. Such a foam supports the desired distribution of the polishing force with a decrease towards the edge of the tool. The measurement of the static modulus of elasticity is carried out in accordance with DIN 53513 at the upper limit of the static range of use; the values apply for shape factor q=3 and a material thickness of 25 mm. Suitable, for example, are mixed-cell polyurethanes, for example Sylomer® foams from Getzner Werkstoffe GmbH, preferably, for example, Sylomer® SR42.

The thickness of the elastic intermediate layer (in the axial direction) can preferably lie between five and 15 mm, further preferably seven and 13 mm. By way of example, it can be 10 mm.

According to the invention, the polishing agent carrier can be a foam, preferably a foam having a density of 0.4-0.7 g/cm$^3$, further preferably 0.5-0.6 g/cm$^3$. The Shore A hardness can preferably lie between 80 and 95, further preferably between 85 and 95. Suitable polishing agent carriers can be obtained, for example, from the Universal Photonics company under the designation LP Unalon®. These are microcellular polyurethanes. The foams can be unfilled or filled with suitable grinding agents such as, for example, metal oxides (for example, corundum, cerium oxide, zirconium oxide), diamond, boron nitride or the like.

Suitable polishing agent carriers are, for example, LP-57 (unfilled, density 0.51 g/cm$^3$, Shore A hardness 88) or GR-35 (filled with zirconium oxide, density 0.59 g/cm$^3$, Shore A hardness 90). These preferred variants are relatively hard polishing agent carriers.

In the prior art, plastic lenses have normally been polished with soft, fibrous or felt-like materials as polishing agent carriers. Surprisingly, it has been shown that, according to the invention, the use of an unusually hard polishing agent carrier is possible, with which a very good smoothing action with respect to waviness with a simultaneously minimal removal of material can be achieved. Because of the considerably lower coefficients of friction as compared with the usual soft polishing agent carriers, these polishing agent carriers that are preferred according to the invention can be operated with considerably higher polishing forces and relative speeds during the machining of plastic lenses without overheating, mechanical overstressing or breakdown of the lubricating film occurring in the process. The porosity of the surface is used as a lubricant reservoir. The use of a polishing agent carrier having the preferred density and preferred Shore A hardness for machining the optical surfaces of plastic lenses therefore deserves separate protection, possibly independently of the specific configuration of the tool. The plastic lenses to be machined can in particular be made of polyurethane or polycarbonate materials. Plastics materials that can be machined particularly well are, for example, allyl diglycol carbonates such as CR-39® from PPG industries or polyurethanes such as the MR® series from Mitsui Chemicals, for example MR-7 or MR-8.

In the event that the optical surface of plastic lenses machined with the polishing agent carriers mentioned here does not achieve the desired properties with respect to its microscopic structure, a further polishing step with a soft, felt-like or fibrous covering material corresponding to the known prior art can be subsequently added. An appropriate tool for such a fine polishing step is in principle constructed in the same way as that mentioned here.

According to a preferred refinement of the invention, a carrier film can additionally be arranged between polishing agent carrier and elastic intermediate layer. The purpose of this carrier film is to reinforce the polishing agent carrier in order to increase the stability of the latter, in particular in the region overhanging the elastic intermediate layer. This carrier film can be, for example, a tear-resistant polyurethane film. Such an additional carrier film can contribute to imparting to the tool the desired shear, pressure and tear resistance and, in addition, the robustness and service life desired under production conditions.

The polishing agent carrier can be formed over the entire area, that is, act with a closed (preferably circular) area on the optical surface to be machined. According to a further embodiment, the polishing agent carrier can have breakouts. These breakouts can be formed, for example, as openings, slots, in particular slots running radially from the edge as far as a central region, or as an edge configuration deviating from a circular ring, for example as a zigzag or wavy edge. The breakouts can firstly serve as a reservoir for polishing agent and secondly, in particular given an appropriate edge configuration, can contribute to the polishing force decreasing towards the edge of the tool. In particular given such a configuration of the polishing agent carrier with breakouts, the carrier film arranged between polishing agent carrier and elastic intermediate layer can contribute substantially to imparting to the tool the desired mechanical properties and adequate stability.

The subject of the invention is, furthermore, the use of a tool as described above for machining optical surfaces of plastic lenses. The machined plastic lenses are preferably made of the materials already described in more detail above, which can be machined particularly well with a tool according to the invention.

The subject of the invention is, furthermore, a method for machining optical surfaces of plastic lenses, including the steps:

a) providing a tool according to the invention; and, b) machining an optical surface of the plastic lens by using the following method parameters:

effective polishing force:

60-110 N, preferably 70-95 N, average relative speed between optical surface and tool 3-6 m/s, preferably 4-5 m/s.

The aforementioned ranges of the relative speed permit the machining time for a polishing operation to be shortened considerably, preferably to a time period of 1 min or less, further preferably 30 seconds or less.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
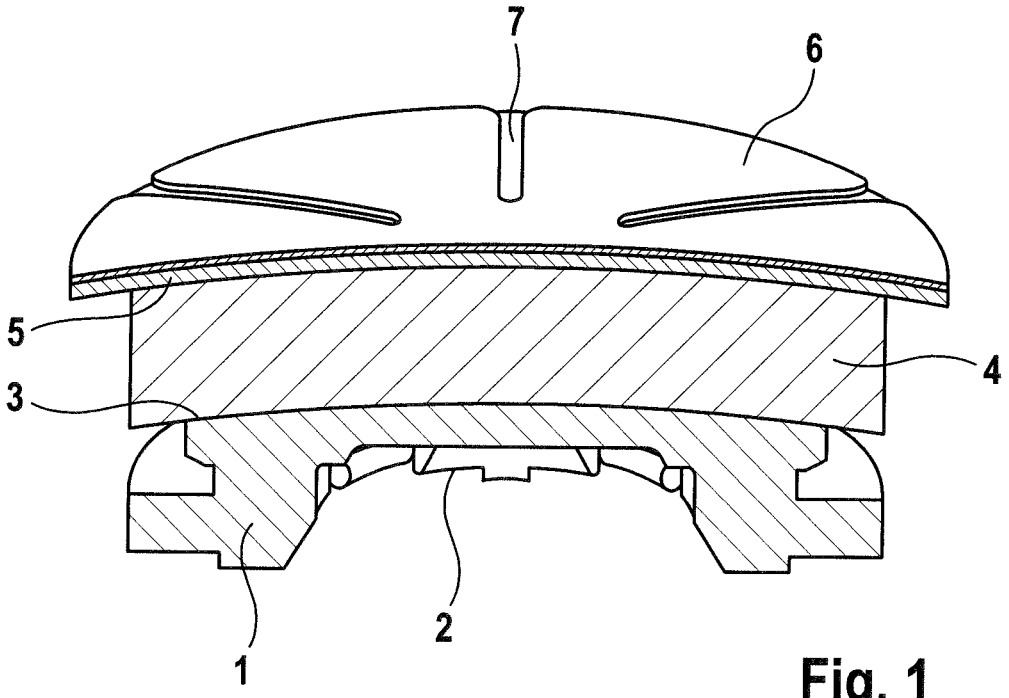
FIG. 1 shows, schematically, an axial section through a tool according to the invention.
Figure 2:
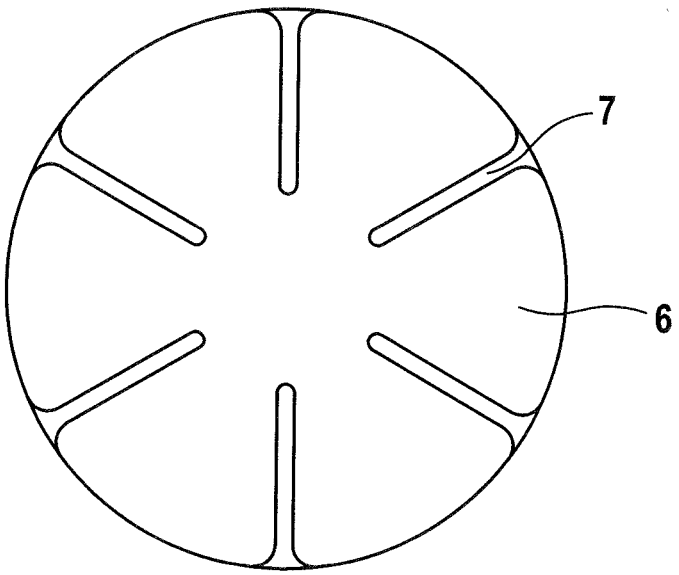
FIG. 2 shows a plan view of the tool from the side of the polishing agent carrier; and, FIG. 3 shows a polishing agent carrier being arranged directly on elastic intermediate layer 4.
Figure 3:
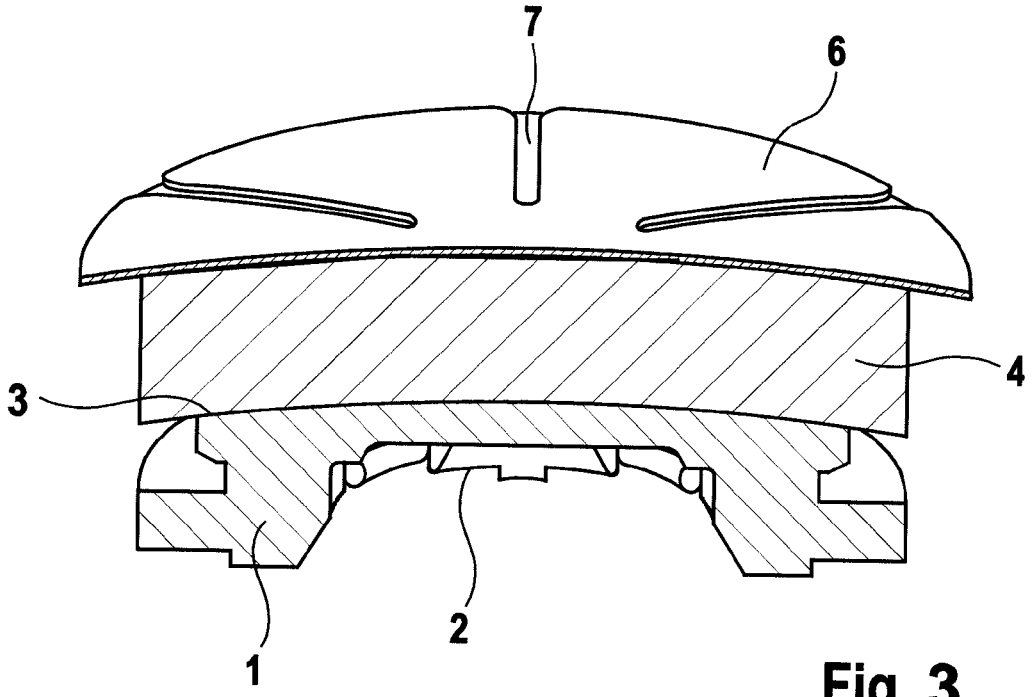

A tool according to the invention has a substantially rotationally symmetrical base 1 which, at 2, has a receptacle for a corresponding holder of a machine tool, a machining robot or the like. Via the receptacle 2, the tool can be set rotating and it is possible for a force to be exerted in the axial direction (in the direction of the axis of rotational symmetry of the tool and the base 1).

The base 1 has an active surface 3 which points in the direction of the optical surface to be machined, which is curved convexly in the exemplary embodiment and has a diameter of 42 mm. Thus, the tool of this exemplary embodiment is used for machining concavely curved optical surfaces.

An elastic intermediate layer 4 is fitted to the active surface 3 of the base 1, preferably adhesively bonded thereto. In the exemplary embodiment, it has a diameter of 50 mm and an axial thickness of 10 mm. The material of this elastic intermediate layer 4 is Sylomer® SR 42. The static modulus of elasticity of this material, determined in accordance with the method explained above, is 0.282 $N/mm^2$.

The elastic intermediate layer 4 thus projects radially by 4 mm beyond the active surface 3 of the base 1, at the edge of the latter.

On the side of the elastic intermediate layer 4 that faces away from the active surface 3, a tear-resistant PU film (D44, Getzner company) is fitted, preferably adhesively bonded on. In the exemplary embodiment, it has a diameter of 58 mm and a thickness of 1.0 mm.

The polishing agent carrier 6 is fitted to the carrier film 5, preferably adhesively bonded on. The polishing agent carrier used in the exemplary embodiment is GR 35, the properties of which have already been described in more detail above.

The largest diameter of the polishing agent carrier 6 in the exemplary embodiment is 58 mm; radially the polishing agent carrier 6 thus ends flush with the carrier film 5. The carrier film 5 and the polishing agent carrier 6 project radially beyond the elastic intermediate layer 4 by 4 mm on each side.

The polishing agent carrier 6 has six breakouts, which are formed radially as slots 7 from the edge towards the inside. The radial extent of each slot 7 from the edge in the direction of the center is about 20.5 mm, the width in the circumferential direction about 2 mm. Thus, a circular segment with a diameter of about 17 mm free of breakouts remains in the center of the polishing agent carrier 6.

The complete process of the production of a spectacle lens using a tool according to the invention is to be explained below by using an example.

A blank of a spectacle lens made of CR-39 material is provided, of which the form of the convex side already corresponds to the optical requirements. The blank is fixed to a holding piece suitable for the machining in a CNC machine. This can be done by blocking onto a blocking piece or clamping in a suitable holding device.

In the next step, the desired prescription surface is generated by using a milling and/or turning method.

In the next step, polishing is carried out in accordance with the method of the invention by using the polishing tool described above in the exemplary embodiment. The polishing agent used is Poly Pro All Format (Satisloh company). The effective polishing force is 70-95 N, the average relative speed between the machined optical surface and the polishing tool is 4-5 m/s. The polishing time lies between 15 and 25 s; in the process five irregular pivoting movements having end positions that change continuously are carried out.

The service life of a tool according to the invention in a method according to the invention carried out in this way is about 200 lenses.

The machined lens has an optical surface without zones, stripes or the like. The Ra value (mean roughness according to DIN EN ISO 4287-1998) lies in the region of about 6 nm, the roughness can be reduced further via a subsequent lacquering process with hard lacquer.

Optionally, an additional fine polishing process can be added. In this case, re-polishing can be carried out, for example, with a fibrous polishing cover (for example Kristall from the DAC company) for about 10 s. In this way, a roughness Ra of about 4 nm is obtained.

It is understood that the foregoing description is that of the preferred embodiments of the invention and that various changes and modifications may be made thereto without departing from the spirit and scope of the invention as defined in the appended claims.

What is claimed is:

1. A tool for polishing an optical surface comprising:

a base body having an active surface configured to face the optical surface;

an elastic intermediate layer arranged on said active surface of said base body and projecting radially beyond said active surface; and, a polishing agent carrier arranged on said elastic intermediate layer and projecting radially beyond said elastic intermediate layer.

2. The tool of claim 1, wherein said active surface has a spherical or a toroidal surface curvature.

3. The tool of claim 1, wherein said elastic intermediate layer projects radially beyond said active surface by 2 to 10 mm.

4. The tool of claim 1, wherein said elastic intermediate layer projects radially beyond said active surface by 3 to 8 mm.

5. The tool of claim 1, wherein said polishing agent carrier projects radially beyond said elastic intermediate layer by 2 to 10 mm.

6. The tool of claim 1, wherein said polishing agent carrier projects radially beyond said elastic intermediate layer by 3 to 8 mm.

7. The tool of claim 1, wherein said polishing agent carrier has an effective diameter lying in a range of 40 to 80 mm.

8. The tool of claim 1, wherein said polishing agent carrier has an effective diameter lying in a range of 40 to 70 mm.

9. The tool of claim 1, wherein:

said polishing agent carrier has a first effective diameter;

said active surface has a second effective diameter; and, said second effective diameter is 50 to 85% of said first effective diameter.

10. The tool of claim 1, wherein:

said polishing agent carrier has a first effective diameter;

said active surface has a second effective diameter; and, said second effective diameter is 60 to 70% of said first effective diameter.

11. The tool of claim 1, wherein said elastic intermediate layer has a static modulus of elasticity lying in a range of 0.1 to 0.5 $N/mm^2$.

12. The tool of claim 1, wherein said elastic intermediate layer has a static modulus of elasticity lying in a range of 0.2 to 0.4 $N/mm^2$.

13. The tool of claim 1, wherein said elastic intermediate layer has a thickness lying in a range of 5 to 15 mm.

14. The tool of claim 1, wherein said elastic intermediate layer has a thickness lying in a range of 7 to 13 mm.

15. The tool of claim 1, wherein said polishing agent carrier is a foam having a density lying in a range of 0.4 to 0.7 $g/cm^3$.

16. The tool of claim 1, wherein said polishing agent carrier is a foam having a density lying in a range of 0.5 to 0.6 $g/cm^3$.

17. The tool of claim 1, wherein said polishing agent carrier is a foam having a Shore A hardness lying in a range of 80 to 95.

18. The tool of claim 1, wherein said polishing agent carrier is a foam having a Shore A hardness lying in a range of 85 to 95.

19. The tool of claim 1 further comprising a carrier film arranged between said polishing agent carrier and said elastic intermediate layer.

20. The tool of claim 1, wherein said polishing agent carrier has breakouts.

21. The tool of claim 1, wherein the optical surface is an optical surface of a plastic glass made of a plastic material selected from a group comprising polyurethanes and polycarbonates.

22. A method for polishing an optical surface of a plastic glass comprising the steps of:

providing a tool for polishing an optical surface having a base body having an active surface configured to face the optical surface; an elastic intermediate layer arranged on said active surface of said base body and projecting radially beyond said active surface; and, a polishing agent carrier arranged on said elastic intermediate layer and projecting radially beyond said elastic intermediate layer; and, polishing an optical surface of the plastic glass using an effective polishing force of 60 to 110 N and an average relative speed between the optical surface and the tool of 3 to 6 m/s.

23. The method of claim 22, wherein the effective polishing force lies in a range of 70 to 95 N; and, the average relative speed between the optical surface and the tool lies in a range of 4 to 5 m/s.

24. A tool for polishing an optical surface comprising:

a base body having an active surface configured to face the optical surface;

an elastic intermediate layer arranged on said active surface of said base body and projecting radially beyond said active surface; and, a polishing agent carrier arranged on said elastic intermediate layer and projecting radially beyond said elastic intermediate layer, wherein said polishing agent carrier has an effective diameter lying in a range of 40 to 80 mm.

25. A tool for polishing an optical surface comprising:

a base body having an active surface configured to face the optical surface;

an elastic intermediate layer arranged on said active surface of said base body and projecting radially beyond said active surface;

a polishing agent carrier arranged on said elastic intermediate layer and projecting radially beyond said elastic intermediate layer;

said polishing agent carrier having a first effective diameter; and, said active surface having a second effective diameter;

wherein said second effective diameter is 50 to 85% of said first effective diameter, wherein said polishing agent carrier projects radially beyond said elastic intermediate layer by 2 to 10 mm, and wherein said polishing agent carrier has an effective diameter lying in a range of 40 to 80 mm.

26. A method for polishing an optical surface of a plastic glass comprising the steps of:

providing a tool for polishing an optical surface having a base body having an active surface configured to face the optical surface; an elastic intermediate layer arranged on said active surface of said base body and projecting radially beyond said active surface; and, a polishing agent carrier arranged on said elastic intermediate layer and projecting radially beyond said elastic intermediate layer; and, polishing an optical surface of the plastic glass using an effective polishing force of 60 to 110 N and an average relative speed between the optical surface and the tool of 3 to 6 m/s, wherein said polishing agent carrier has an effective diameter lying in a range of 40 to 80 mm.

27. A method for polishing an optical surface of a plastic glass comprising the steps of:

providing a tool for polishing an optical surface having a base body having an active surface configured to face the optical surface; an elastic intermediate layer arranged on said active surface of said base body and projecting radially beyond said active surface; and, a polishing agent carrier arranged on said elastic intermediate layer and projecting radially beyond said elastic intermediate layer; and, polishing an optical surface of the plastic glass using an effective polishing force of 60 to 110 N and an average relative speed between the optical surface and the tool of 3 to 6 m/s, wherein said polishing agent carrier has a first effective diameter, wherein said active surface has a second effective diameter, wherein said second effective diameter is 50 to 85% of said first effective diameter, wherein said polishing agent carrier projects radially beyond said elastic intermediate layer by 2 to 10 mm, and wherein said polishing agent carrier has an effective diameter lying in a range of 40 to 80 mm.

* * * * *